United States Patent [19]

Dorsett et al.

[11] Patent Number: 4,772,361

[45] Date of Patent: Sep. 20, 1988

[54] APPLICATION OF ELECTROPLATE TO MOVING METAL BY BELT PLATING

[76] Inventors: Terry E. Dorsett, 11205 Hosford Rd., Chardon, Ohio 44024; David P. Rininger, 505 Courtland St., Fairport Harbor, Ohio 44077; Thomas G. Strempel, 23601 Colbourne Rd., Euclid, Ohio 44123

[21] Appl. No.: 128,734

[22] Filed: Dec. 4, 1987

[51] Int. Cl.[4] ..... C25D 7/06; C25D 17/00

[52] U.S. Cl. ..... 204/28; 204/206; 204/224 R

[58] Field of Search ..... 204/28, 206, 224 R

[56] References Cited

U.S. PATENT DOCUMENTS

| | | | |
|---|---|---|---|
| 3,661,752 | 5/1972 | Capper et al. | 204/206 |
| 3,904,489 | 9/1975 | Johnson | 204/15 |
| 3,951,772 | 4/1986 | Bick et al. | 204/198 |
| 3,966,581 | 6/1976 | Holte | 204/202 |
| 4,304,653 | 12/1981 | Winand | 204/206 |
| 4,416,756 | 11/1983 | Martin | 204/206 |
| 4,564,430 | 1/1986 | Bacon et al. | 204/206 |
| 4,661,213 | 4/1987 | Dorsett et al. | 204/15 |

FOREIGN PATENT DOCUMENTS

| | | | |
|---|---|---|---|
| 14091 | of 1909 | United Kingdom | 204/206 |

*Primary Examiner*—T. M. Tufariello

*Attorney, Agent, or Firm*—John J. Freer

[57] ABSTRACT

An anodic belt electroplating apparatus utilizes a flexible, electrolyte permeable belt anode with porous outer belt covering that provides flexible operation parameters. The perforate belt anode such as of valve metal in mesh form, has an electrocatalytic coating and an electrolyte-containing wrap for the outer belt covering. Processing parameters can provide desirable electroplate, such as of metal coils electroplated in strip form through an at least substantially flat and horizontal electroplate zone, at highly desirable plating speeds as well as providing careful control over plate composition and deposition thickness.

43 Claims, 1 Drawing Sheet

APPLICATION OF ELECTROPLATE TO MOVING METAL BY BELT PLATING

BACKGROUND OF THE INVENTION

Although application of electroplate to a metal substrate may be facilitated by roller electroplating process, e.g., as taught in the U.S. Pat. No. 4,661,213, various other types of pad plating equipment have been developed to take advantage of such types of plate application when the metal substrate is in extended form, e.g., a metal wire or metal strip. A pad can carry an electrolyte and be run in a direction of travel of the workpiece, or against the direction of travel of the workpiece. In addition to carrying the electrolyte, the pad should be resistant to the electrolyte, it having been found that Dacron can sometimes be suitable for such application, as disclosed for example in U.S. Pat. No. 3,661,752.

It has also been taught that if an electrolyte zone can be established between anode and cathode, the cathode may be provided by an endless belt, more particularly an endless metal belt as disclosed in U.S. Pat. No. 4,304,653.

However, electroplating wherein a solution is applied to a plating belt for carrying the solution has ostensibly attracted greater attention. In this regard a belt having fabrication similar to a paint roller has been studied. Such a belt can comprise a fabric backing material, such as Dacron or the like, which is secured to a fibrous nap, made for example of Dynel. Such a belt plating apparatus has been disclosed in the U.S. Pat. Nos. 3,951,772, 3,904,489 and 3,966,581.

There has also been investigated the utilization of belts where a depletable anode may be employed. For example, a roller anode can be wrapped in a porous mesh which thereby comes into contact with the strip workpiece. The porous mesh can enhance uniform erosion of the depletable anode roll as it is being sacrificed during electroplating, such as taught in the U.S. Pat. No. 4,416,756.

More recently in the U.S. Pat. No. 4,564,430 there has been disclosed a contact plater for continuously plating a workpiece. The plater employs a continuous loop of material that is inert to the plating solution. A porous covering for absorbing the plating solution can be mounted on the continuous loop.

There is nevertheless a need for improvement to provide a belt plating system having a highly economical operation coupled with extended operation. A plating apparatus should allow for plating at high current densities, yielding a smooth and even deposit. Such plating aspects should desirably be coupled with flexible processing allowing for fast application of carefully controlled electroplate composition.

SUMMARY OF THE INVENTION

An anodic belt electroplating apparatus has now been assembled which can achieve desirable electroplate operation. Such is achieved in part by means of a flexible, electrolyte permeable, continuous and non-sacrificial belt anode bearing an electrolytic coating, with such belt anode having a porous resin covering wrap is snug fit. With the assembled apparatus, durability and thoroughness of operation are combined with a highly efficient electroplating process. The equipment can lead to fast application, obtaining enhanced electroplate deposition with carefully controlled composition and amount of deposit.

Highly desirable electrolyte movement occasioned by the anode wrap scrubbing action of the electroplate workpiece can provide for most elevated current density. Such scrubbing action also leads to accelerated removal of by-product gases from the plating zone. Electroplating is achieved in fast operation in a confined work area and yet desirable plate appearance is obtained with reduced equipment wear. Flexibility of operation can include stripe plating as well as proportional width plating. Moreover there may be attained two-sided strip plating as well as multi-layer electroplating in successive plating cells. When replacement and refurbishing is required, such is facilitated by the equipment of the present invention.

In its broadest aspect, the invention is directed to a belt electroplating apparatus adapted for the high speed electroplating of a moving strip of metal, which electroplating apparatus comprises: A flexible, perforate and electrolyte permeable continuous and non-sacrificial belt anode having an exterior surface of electrocatalytic coating; a thermoplastic, non-conductive and acid-resistant porous resin covering in snug fit around the flexible belt anode, having a thickness of not substantially greater than about 1.5 centimeters as well as having interconnected voids providing porosity of at least about 50 percent by volume; cylindrical, non-conducting coated drive rolls; cylindrical valve metal anodic electrical contact rolls; liquid supply means adjacent to the electrical contact rolls whereby liquid electrolyte is supplied to the belt anode porous resin covering through such perforate belt anode; electrical supply means supplying electrical current to the electrical contact rolls, such electrical supply means comprising resilient electrical supply members in contact with such rolls; and liquid removal means including collection means positioned below the liquid supply means.

In another aspect, the present invention is directed to belt electroplating equipment providing ease of servicing and parts replacement by having a movable carriage member inter-engaging drive rolls, anode coating rolls, and the belt anode.

In yet a further aspect, the invention is directed to a method of metal electroplating a moving strip of metal wherein a moving belt anode provides for contact to a cathodic metal strip.

DESCRIPTION OF THE PREFERRED EMBODIMENTS

Figure 1:
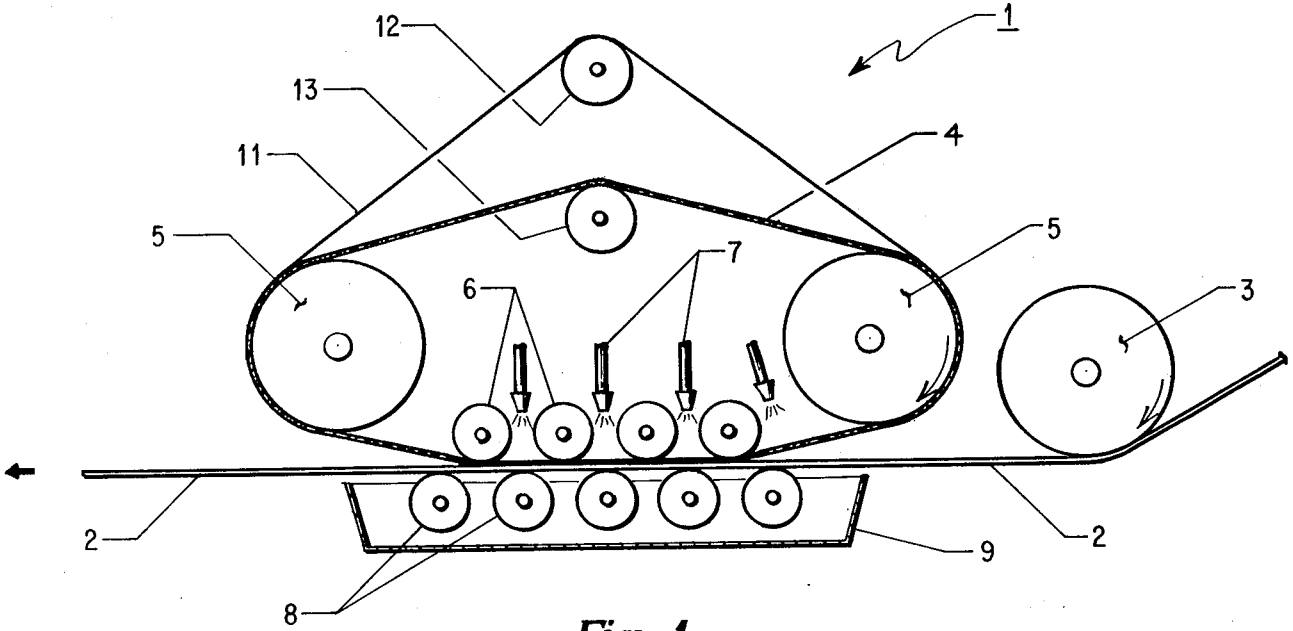
FIG. 1 is a perspective view of belt plating apparatus, including a metal strip workpiece, of the present invention.

As shown in FIG. 1, a metal strip 2 comes into contact with a cathode contact roll 3 before the strip proceeds to a plating cell unit shown generally at 1. The plating cell unit 1 has a belt anode 4. The belt anode 4 is driven by drive rolls 5. In between the drive rolls 5, and located somewhat below these rolls 5, are a sequence of anode contact rolls 6. Located just above and between these anode contact rolls 6 are electrolyte spray headers 7. Located below the anode contact rolls 6 are lower backup rolls 8. Beneath the backup rolls 8 is an electrolyte collection tray 9. Wrapped around the belt anode 4 for snug contact with the anode 4 through the electroplating zone, i.e., the zone between the anode contact rolls 6 and backup rolls 8, is an electrolyte permeable anode wrap or covering 11. Although the anode wrap 11 may be in a continuous loop and in snug fit with the belt anode 4, as an option shown in FIG. 1, the anode wrap 11 in the upper area above the belt anode drive rolls 5 can pass around an anode wrap idler roll 12. In another alternative, the anode wrap 11 may be continuously fed into snug fit with the belt anode 4 from a payoff roll, not shown, and after passage through the electroplating zone, continue beyond such zone to a takeup roll, not shown. For the belt anode 4, in an option also shown in FIG. 1, at the area above the belt anode drive rolls 5, the belt anode 4 can be passed over a belt anode idler roll 13. Furthermore, the metal strip 2 may proceed in tangential contact with the cathode contact roll 3, but will more often be wrapped around each roll 3 as shown in the figure.

Thus, in operation as shown in FIG. 1, a metal strip 2 proceeds initially into partially wrapped, electrical contact with the cathode contact roll 3. Current can be fed to the cathode contact roll 3, such as from conductive brushes, not shown, positioned in contact with a central shaft of the roll 3. Subsequent to this contact between strip 2 and roll 3, the metal strip 2 enters the plating cell unit 1. As it proceeds into the plating cell unit 1, it is supported on the backup rolls 8. As the metal strip 2 continues across the series of backup rolls 8, it then proceeds into contact with the anode wrap 11 of the belt anode 4. At substantially this juncture, the belt anode 4, driven in a rotational path by the belt anode drive rolls 5, is proceeding into contact with the anode contact rolls 6, when the plating cell unit 1 is operating in the direct coating technique. The metal strip 2, belt anode 4 and anode wrap 11 then proceed through the path open between the lower backup rolls 8 and upper anode contact rolls 6. If the drive rolls 5 and anode contact rolls 6 are both driven, such as by an external chain drive or the like, not shown, such rolls 5, 6 will virtually always be driven at the same linear speed. Electrical current may be impressed on the anode contact rolls 6 in the manner as for the cathode contact roll 3. It is also contemplated that additional anode contact elements can be present between the anode contact rolls 6. Such additional elements may take the form of brush means, e.g., in the manner of a bottle-brush-formed element that could rotate into metallic bristle contact with the belt anode 4, or as a stationary element contact with the belt anode 4.

While proceeding through the above-mentioned open path, and while the metal strip 2 is in contact with the anode wrap 11, electrolyte feeding from the electrolyte spray headers 7 readily penetrates through the electrolyte permeable belt anode 4 thereupon flooding the anode wrap 11 and thus providing liquid electrolyte to the metal strip 2. Excess electrolyte proceeding past the strip 2 and the backup rolls 8 will be retained by the electrolyte collection tray 9. It is also contemplated that the backup rolls 8 may be replaced by a support plate, e.g., in strip form. Such a plate can be a lubricated plate or may employ a lubricious material of construction such as polytetrafluoroethylene.

Above the just-described electroplating zone, as the anode wrap 11 and belt anode 4 emerge from the zone and travel around the belt anode drive roll 5, the belt anode 4 may optionally come into contact with a belt anode idler roll 13. Such idler roll 13 can be useful for providing tension uniformity on the belt anode 4 during continuous plating operation. Likewise, the anode wrap 11, in the area above the belt anode drive rolls 5, may be tensioned by the anode wrap idler roll 12. It will be appreciated that the plating cell unit 1 can likewise be operational in reverse belt coating technique whereby the belt anode 4 and adjoining anode wrap 11 will be rotated in a generally counterclockwise direction for FIG. 1 so as to enter the plating zone at the area wherein electroplated metal strip 2 is exiting such zone. In either reverse or direct belt plating technique, the belt anode 4 and anode wrap 11 will be suitably driven by the drive rolls 5 simply by the friction engagement, optionally under idler roll tensioning, of the belt anode 4 with the drive rolls.

External to the plating cell unit 1 of FIG. 1, arms, not shown, may extend to both the anode contact rolls 6 and the drive rolls 5. These arms, together with equipment present in conjunction therewith may form a carriage. In operation, this carriage can then be useful for removal of the rolls 5, 6 from the electroplating zone as well as for their repositioning to such zone. This will enhance ease of repair and replacement for equipment in the unit 1. Where idler rolls 12, 13 are present, carriage arms may likewise be connected with these rolls 12, 13.

As the electroplated metal strip 2 leaves the area under the anode contact rolls 6, forced air blowing across the strip 2 can be useful for lessening electrolyte flooding. Also, water rinsing of the metal strip 2, e.g., with tap water, after electroplating and forced air treatment, may be employed to rinse away excess electrolyte. Subsequent application of forced, heated air can be used to dry the strip 2.

From the electrolyte collection tray 9, electrolyte may circulate away from the belt plater, e.g., to a replenishing bath. In such circulation the electrolyte cannot only be replenished, but may also be cooled. The cooled and freshened electrolyte will then be recirculated back to the plating area, such as to a plating tank feeding the electrolyte spray headers 7. It is possible to maintain a plating tank of small volume relative to such tanks in other typical plating operations. Such can require electrolyte cooling but also facilitates ease of replacing plating tanks, e.g., using interchangeable plating tanks during extended electroplating operation.

The metal strip 2 will generally be in any planar, flexible form for plating such as plate or sheet form, but will most always be simply in strip form. A variety of conductive metals for the metal strip 2 are contemplated, such as nickel, iron, steel and their alloys but most generally will be steel for product economy. Prior to electroplating, the metal strip may receive pretreatment including typically any of those that are conventional in the art. The strip will most always be cleaned and may be cleaned and pickled. Further, such pretreatment can include one or more heat-treating operations to anneal the strip, such as prior to cleaning or cleaning and pickling.

The exterior metal portions both of the belt anode and the anode contact rolls will usually be made of corrosion-resistant metal. This would be a resistance to corrosion from the electrolyte and therefore the metals will typically be resistant to acid corrosion. Acid-resistance, as well as electroconductivity, are considerations that are given to selecting the metal not only for the belt anode but also for at least the exterior metal of the anode contact rolls. This exterior metal will typically be a valve metal such as titanium, tantalum, zirconium, tungsten, silicon, niobium, their alloys or their intermetallic mixtures. For excellent corrosion resistance and sufficient electrical conductivity coupled with economy, titanium is the metal of choice.

Most typically for belt anode durability, the electrolyte permeable belt will be prepared from metal in wire form. Individual wire strands can have a thickness of on the order of from about 0.15 to about 0.25 centimeter. Preferably, for best ruggedness of construction coupled with economy of materials, the metal for the belt anode will be a titanium wire having a strand thickness of about 0.2 centimeter. The electrolyte porous and flexible belt anode can be prepared from interconnected metal strands forming a mesh structure. One form of mesh can be provided by multiple wire spirals connected to each other by straight wire rods which are passed through adjacent spirals, thus interlocking them. Other meshes may be chain link structures as well as expanded or perforated sheets, or linked, perforated plates. The interlocked wires will provide from about 30 to about 70 percent of the area of the mesh at its broad surface, the balance being openings to pass electrolyte through the mesh. A metal area for a mesh belt anode of less than about 30 percent can provide for a too highly porous mesh of insufficient strength of construction. On the other hand, a metal area of greater than about 70 percent for the metal strands may act to retard best electrolyte flow through the mesh to the outer porous anode wrap. Most usually the broad surface of the mesh will be between about 40–60 percent metal with a 60–40 percent balance of openings.

As mentioned hereinabove, at least the exterior metal of the anode contact rolls can be the same or similar metal as the metal of the belt anode. Thus for economy and durability, titanium is the preferred metal. This metal may be deposited, e.g., clad, on to a center shaft. The center shaft is a desirably electrically conductive metal such as copper. The backup rolls may be of similar construction, but most always are non-conductive, e.g., polytetrafluoroethylene.

To provide for the most desirable electroplate operation, the belt anode contains an electrocatalytic coating. The anode contact rolls may likewise be coated with the same or different electrocatalytic coating as applied to the belt anode. This electrochemically active coating prevents passivation of the valve metal belt anode that could deter its function as an electrode. The electrochemically active coating can be provided by platinum or other platinum group metal, or it may be supplied by a number of many active oxide coatings such as magnetite, ferrite, cobalt spinel, or mixed metal oxide coatings, which have been developed for use typically as anode coatings in the industrial electrochemical field. It is particularly preferred for extended life protection of the belt anode that the coating be a mixed metal oxide, which can be a solid solution of a film-forming metal oxide and a platinum group metal oxide. For purposes of convenience herein, a valve metal may also be referred to as a "film-forming" metal.

Where the active coating is provided by platinum or other platinum group metal, it is understood that such metals can include palladium, rhodium, iridium, ruthenium and osmium or alloys of these metals themselves as well as with other metals. It is preferred for best electrode operation that the coating be a solid solution containing tantalum oxide and iridium oxide.

Although it is contemplated that other materials may be useful, e.g., fiber glass or ceramic materials, a durable, non-conductive, acid-resistant outer porous thermoplastic resin covering is used and is in snug fit as a wrap around the belt anode. For convenience, such wrap will generally be referred to herein as the thermoplastic porous resin covering or wrap. It is necessary that this covering readily hold the electrolyte. For best coating efficiency, this porous wrap should have a thickness of not substantially greater than about 1.5 centimeters. In most desirable operation, it is preferred that such wrap be thinner, e.g., have a thickness on the order of 0.5 centimeter, or even less. The wrap should be in tight fit around at least that portion of the belt anode that is traveling through the coating zone, to provide enhanced uniformity of coating operation as well as economy and durability of operation. A loose fitting wrap can lead to undesirably excessive wear in the wrap during operation. In general, so long as the wrap is higly porous, it may be woven or non-woven, contain voids, or have interconnected pores, so long as electrolyte can readily flow through the wrap. Therefore for best electrolyte flow and fast electroplate deposition, the wrap will have a void volume of at least about 50 percent. This can be void space or porosity, so long as the porosity comprises at least substantially interconnected pores for electrolyte flow. Typically, wrap porosity will have pore diameters within the range from about 1 micron to about 100 microns. For the most advantageous low voltages in operation coupled with desirable electrolyte retention capacity, the wrap will have a void volume (porosity) of from about 50 to about 90 percent or even more, e.g., up to about 95 percent.

In typical operation the metal workpiece can be electroplated by a variety of electroplate metals including cobalt, copper, nickel, tin, zinc and combinations, such as zinc-nickel, zinc-iron, and including alloy and intermetallic combinations. Such electroplated metals will typically be deposited from acid electrolytes. Considering zinc electroplate as illustrative, chloride electrolytes or sulfate electrolytes may be useful, e.g., at a bath pH of less than 1.0 using concentrated additions of acid, to a bath pH on the order of 3–4. Hence the plating solutions employed may be those generally used in the electroplating field. The acidic solutions are most always contemplated and these can be used heated at elevated temperature. Thus a representative electroplating solution which has been found to be serviceable is a Watts nickel plating bath which may be heated for use at a temperature such as 140° F.

The wrap is a non-conductive and acid-resistant porous covering. Acid resistance, as mentioned hereinabove, will provide resistance against degradation of the covering by typical electrolyte. A synthetic thermoplastic resin covering can combine desirable snug fit for the covering over the belt anode, coupled with covering durability in operation. For best durability and acid resistance, the preferred thermoplastic resin coverings are polyamide resin coverings, polyolefin coverings such as a polypropylene resin covering, or blends of same. Additionally, the wrap may also be such thermoplastic resin containing integrally bound, very finely divided particulates, such as a talc filler. In addition to being very finely divided, e.g., having particle size measured in microns, the filler should be acid resistant and be sufficiently hard to assist in the durability of the wrap, yet not so hard as to deleteriously mar the electrodeposit coating.

The belt anode drive rolls as well as the anode wrap idler roll or the belt anode idler roll can be of similar construction. Any durable and non-electrically conductive material will be suitable, e.g., neoprene or other rubber rolls. Alternatively, these rolls can be metal rolls, usually steel for economy, which can be provided with a non-electrically conductive coating. Thus suitable materials for the idler rolls and the drive rolls are a rubber-coated mild steel. The cathode contact roll can be constructed of any durable electrically conductive material for suitably performing as a cathode. For best durability, such cathode roll is advantageously a metal roll and for durability plus economy, a stainless steel cathode contact roll is preferred. Elements of the plating cell unit coming into contact with electrolyte may be made of any serviceable electrolyte resistant, e.g., acid-resistant material. For economy, a resinous material is advantageously used such as polypropylene or other thermoplastic including acrylonitrile-butadiene-styrene (ABS) resin or chlorinated polyvinyl chloride (CPVC) resin. Thus the electrolyte spray headers as well as the electrolyte collection tray can be desirably constructed of such materials.

Typically, in operation, the belt anode can be operated at from about 0.5 ampere up to about 250 amperes without deleterious materials degradation, although at low voltage, e.g., on the order of 15–20 volts, amperages of as great as 1,000 or more may be useful. Owing to the combination of the amperage permissible and the contact between the belt anode plus anode wrap and the metal workpiece, although electroplating can proceed at a current density of on the order of 1,000 to 2,000 amperes per square foot (ASF), it will usually proceed at a current density of not substantially less than about 3,500 ASF of electrode area, e.g., of no less than on the order of 3,300–3,400 ASF. Most typically, the current density can vary from about 4,000 up to about 6,000 ASF, although more elevated current densities, e.g., 7,000–10,000 ASF may be achieved.

It is not necessary that the belt anode and wrap be operated in a reverse belt coating mode. A direct belt coating mode is also suitable so long as there is relative movement between the anode plus wrap and the metal workpiece to be electroplated. In general the relative movement will be at a ratio of on the order of about 1.5:1, i.e., the rotational speed of the anode plus wrap, for example, will be 1.5 times the speed of the metal workpiece, although greater relative ratios can be tolerated. Moreover, especially where the linear velocity of the workpiece is at a substantial rate, it is to be understood that the linear velocity of the anode plus wrap may be less than that of the workpiece. Such relative movement provides an electroplate of desirable characteristics on the workpiece in a fast and economical manner. More importantly, for operational economy, is the linear velocity of the anode plus the anode wrap.

It will be most typical to operate the belt anode plus anode wrap at a linear velocity within the range of from about 10 to about 1,000 feet per minute, relative to the speed of the workpiece. Although higher speeds are contemplated, typical advantageous linear velocities can be from about 25 to 750 feet per minute. In such operation, a rapid scrubbing-type of action can be achieved during electroplating between the moving metal strip and the rotating belt anode outer wrap. Such high speed, rapid operation will not only remove by-product gases from the electroplate zone, but can also assist in achieving the high current density plating of the present invention. In such coating operation, and referring again to zinc electroplating as illustrative, a polished, bright uniform and reflective electroplate deposit can be obtained. Such deposit, in addition to having highly desirable reflective appearance, will have further desirable coating parameters, e.g., corrosion resistance and coating adhesion. Although only one plating cell unit has been shown in the figure, it is to be understood that additional cell units in series can be employed. The electrolyte composition could be varied from unit to unit. Hence a workpiece proceeding through successive cells may receive a multi-layer electroplate coating.

Following the coating operation, the electroplated workpiece will be suitable for further operation in typical commercial practice. For example, the workpiece may be heat treated or if in strip form can be coiled and stored for subsequent use. The workpiece may also proceed to further operation such as for additional corrosion resistance, e.g., a treatment such as etching or pickling, and subsequent coating. The subsequent coating operations could include pretreating operations such as phosphatizing and chromating, following by painting. Thus the finished article can include a variety of products which may be painted as well as electroplated metal substrates. Furthermore, although the apparatus has been described for use in application of electroplate, it is to be understood that such may also be useful in related operation. Thus it is contemplated to employ the apparatus such as for electrocleaning, electropickling and electroforming.

The following examples show ways in which the invention has been practiced, but should not be construed as limiting the invention.

EXAMPLE 1

Belt plating apparatus was constructed in conformance with the arrangement depicted in FIG. 1. The belt anode was of interlocking titanium wire, forming a mesh. The mesh had a strand thickness of approximately 0.19 centimeter and was a multiple of wire spirals, connected to each other by straight titanium wire rods, passed through adjacent spirals. The wires, and thus the mesh belt anode, had an electrocatalytic coating at its exterior surface of mixed oxides. Such catalysts have been disclosed for example in U.S. Pat. No. 3,926,751. The resulting mesh belt anode was approximately 178 centimeters in length and 23 centimeters in width. Wrapped snugly around the titanium anode was a non-conductive and highly porous wrap. This wrap had a thickness of 0.8 centimeter, and was a non-woven web consisting of polyamide fiber with urethane resin. The wrap contained a talc filler and had a porosity exceeding 60%. It was virtually of the same width and length as the catalytically coated, titanium mesh anode belt. The wrapped titanium mesh belt anode was driven by two rubber-coated mild steel drive rolls. No separate idler roll was employed for the belt anode wrap. The drive rolls were of equal size and each were 15.2 centimeters in diameter. Four anode rolls, all of the same size, were positioned between the drive rolls. These anode rolls were each 7.6 centimeters in diameter and 23 centimeters in length. The anode rolls were titanium-clad copper. Each anode roll was a solid roll and individual rolls were paced 10.2 centimeters apart, center-to-center. The rolls passed through a solid copper bar support, at the end of each roll. Spring-loaded copper/-graphite brushes pushed against a side of the shaft within the bar to provide electrical contact between the copper support bar and the individual anode roll.

Spaced between the anode rolls were electrolyte spray headers. These spray headers were tubes, positioned parallel to the anode rolls, with holes offset within the tubes such that they offer an electrolyte feed to the rolls in offset manner. The supply headers were made of chlorinated polyvinyl chloride (CPVC), were 23 centimeters in length, contained 11 holes per header, with each hole being 0.2 centimeter diameter and with the holes being 0.95 centimeter apart. Positioned beneath the anode rolls were a series of five backup rolls. These were solid, titanium-clad copper rolls with polytetrafluoroethylene end sleeves. The rolls were spaced 10.2 centimeters apart and were used as cathode contact rolls. Below these backup rolls was a CPVC electrolyte collection tray.

For purposes of the test there was employed a four-inch wide coil of cold rolled steel that was of 20 gauge. In feeding to the coating apparatus, the steel strip is first passed through a cleaning section. In this section the strip is cleaned by immserion in an aqueous solution containing 4 ounces of alkaline cleaning solution per gallon of water. This solution is a commercially available material of typically relatively major weight amount of sodium hydroxide with a relatively minor weight amount of a water-softening phosphate. This cleaning bath is maintained at a temperature of about 150° F. During the cleaning operation the steel strip, all flooded with the cleaning solution, is lightly scrubbed with a roller bristle brush. As the strip proceeds from the cleaning operation, it is then thoroughly rinsed with 110° F. tap water. It is thereafter dried with an air knife.

Following the cleaning, rinsing and drying, the metal strip proceeds into contact with the roller steel cathode. Thereafter it is brought into contact with the belt plating apparatus, by traveling across the backup rolls while being plated on the top of the strip which is in contact with the electrolyte-filled wrap.

For this test a zinc sulfate coating solution is employed. This coating bath contains 125 grams per liter (g/L) of zinc sulfate ($ZnSO_4.H_2O$) as well as 1.5 cubic centimeters of a concentrated non-ionic wetter. These ingredients were dissolved in deionized water. The bath was adjusted to a pH of below 1.0 using sulfuric acid. This electrolyte is maintained at room temperature and is fed at a rate of 15 liters per minute through flexible tubing to the spray headers.

The anode contact rolls are made anodic using a DC rectifier providing constant current and these rolls are moved at 77 feet per minute in a counterclockwise direction which provides movement opposing the directional movement of the approaching steel strip. The steel strip proceeds in contact under the anode contact rolls at a line speed of 5 feet per minute. The electroplating proceeds at a current density of 1,050 ASF of anode contact area.

As the electroplated strip emerges from the anode contact rolls, air is blown across the strip to retard electrolyte flooding of the strip. Thereafter, tap water at room temperature is used to rinse electrolyte from the strip. Lastly, forced heated air at a temperature of about 100°-140° F. is blown down onto the strip for drying. The resulting dried strip proceeds to recoiling operation. By this operation the steel substrate receives a uniform zinc electroplate deposit of 70 grams per square meter of substrate metal. The deposit is observed by visual observation to be a smooth, even deposit along as well as across the strip.

EXAMPLE 2

The coating apparatus of Example 1 was again employed, but a cathode contact roll of 10.2 centimeters in diameter and 37 centimeters in width, positioned 56 centimeters before the first anode contact roll was employed. A steel strip is described in Example 1 was prepared for electroplating in the manner of Example 1. The electrolyte used was as a zinc sulfate plating bath containing 125 g/L of zinc sulfate. The bath also contained in the minor amount of non-ionic wetter, as described in Example 1, all in deionized water, and had a pH of under 1.0 as adjusted be addition of 125 g/L of sulfuric acid.

All in the manner as hereinbefore described in Example 1, this zinc sulfate electrolyte was electroplated onto a cold rolled steel substrate, excepting the strip line speed was 10 feet per minute (ft/min) and the linear velocity of the anode plus wrap was 73 ft/min. For this plating a current of 1,000 DC amperes and 20 DC volts was used providing a current density of about 2,250 ASF. Following rinsing and drying of the electroplated steel, the zinc electroplate was observed to be a bright, smooth and even deposit of 48 grams per square meter of substrate metal and containing no readily visible rough or porous spots. In further testing, the strip is topcoated with DACROMET® corrosion resistant topcoating composition known to contain hexavalent chromium substance and particulate zinc and available from Metal Coatings International Inc. For comparative purposes, a commercially available electrogalvanized test panel is selected. The test panel is known to contain a comparable weight of zinc electroplate to the test panel prepared by the present invention. This comparative panel is likewise topcoated with a comparable coating weight of the DACROMET® coating composition. In comparative corrosion resistance as well as coating adhesion testing, the test panel prepared by the method of the present invention is found to provide equivalent corrosion resistance and coating adhesion to the commercially available panel.

EXAMPLE 3

The apparatus and procedures of Example 2 were again employed except that the steel strip was partially wrapped around the cathode roll and the linear velocity of the anode plus wrap was about 62 ft/min. During electroplating, electroplating proceeded at 1,000 DC amperes and 22 DC volts providing an electroplating current density exceeding 2,250 ASF. As in Example 2, the resulting zinc electroplating was found to be a smooth and uniform deposit having a highly desirable bright finish. The electrolyte was found to deposit on a four-inch wide steel strip 37 grams of zinc electroplate per square meter of the strip.

In further testing, this strip is topcoated with a DACROMET® corrosion resistant topcoating composition such as has been mentioned in Example 2. For test panels cut from the strip that are provided with an 0.300 inch dome for testing, such are found to exhibit no red rust on the punched dome when subjected to 600 hours of salt spray testing conducted in accordance with the provisions of ASTM B-117.

EXAMPLE 4

The apparatus and procedures of Example 2 were again employed except that the steel strip linear velocity was 30 ft/min and the linear velocity of the anode plus wrap was 250 ft/min. During electroplating, electroplating proceeded at 1,750 DC amperes and 26 DC volts providing an electroplating current density exceeding 3,900 ASF. As in Example 2, the resulting zinc electroplating was found to be a smooth and uniform deposit having a highly desirable bright finish. The electrolyte was found to deposit on a six-inch wide steel strip 29 grams of zinc electroplate per square meter of the strip.

What is claimed is:

1. A belt electroplating apparatus adapted for the high speed electroplating of a moving strip of metal, which electroplating apparatus comprises:

a flexible, perforate and electrolyte permeable continuous and non-sacrificial belt anode having an exterior surface of electrocatalytic coating;

a thermoplastic, non-conductive and acid-resistant porous resin covering in snug fit around said flexible belt anode, having a thickness of not substantially greater than about 1.5 centimeters as well as having interconnected voids providing porosity of at least about 50 percent by volume;

cylindrical, non-conducting coated drive rolls;

cylindrical valve metal anodic electrical contact rolls;

liquid supply means adjacent said electrical contact rolls whereby liquid electrolyte is supplied to belt anode resin covering through said perforate belt anode;

electrical supply means supplying electrical current to said anodic electrical contact rolls and comprising resilient electrical supply members in contact with said rolls; and liquid removal means including collection means below said liquid supply means.

2. The apparatus of claim 1 wherein said belt anode is a metal mesh anode of a great multitude of interlocking metal wire members.

3. The apparatus of claim 1 wherein said anode is a valve metal belt anode of a metal selected from the group consisting of titanium, tantalum, zirconium, tungsten, silicon, niobium, their alloys and their intermetallic mixtures.

4. The apparatus of claim 1 wherein said belt anode electrocatalytic coating contains metal oxide.

5. The apparatus of claim 4 wherein said metal oxide is a mixed metal oxide containing a platinum group metal selected from the group consisting of platinum, palladium, rhodium, iridium, ruthenium, osmium and their alloys.

6. The apparatus of claim 1 wherein said belt anode comprises a continuous loop in contact with said coated drive rolls as well as in contact with said electrical contact rolls.

7. The apparatus of claim 1 wherein said porous resin covering is an electrolyte permeable covering having a thickness of not substantially greater than about 0.5 centimeter.

8. The apparatus of claim 1 wherein said porous resin covering is a matted, non-woven and tangled fiberous covering containing a particulate, non-conductive filler.

9. The apparatus of claim 1 wherein said porous resin covering is comprised of synthetic thermoplastic resin consisting of one or more of polypropylene or polyamide resins.

10. The apparatus of claim 1 wherein said porous resin covering has porosity of from about 50 to about 95 percent by volume and has pore diameters within the range of from about one micron to about 100 microns.

11. The apparatus of claim 1 wherein said porous resin covering is in snug pressure fit to said belt anode without adhesive or mechanical bonding.

12. The apparatus of claim 1 wherein said porous resin covering is a continuous loop covering fit around a continuous loop anode.

13. The apparatus of claim 1 wherein said porous resin covering is fed onto said belt anode from a payoff roll and upon removal from said anode is rewound onto a take-up roll.

14. The apparatus of claim 1 wherein said porous resin covering is a continuous loop covering of greater linear dimension than said anode, and said loop covering is fit around an idler roll.

15. The apparatus of claim 1 wherein said drive rolls are rubber coated metal drive rolls.

16. The apparatus of claim 1 wherein said anodic electrical contact rolls have valve metal covering around an electrically conductive metal substrate roll.

17. The apparatus of claim 1 wherein said valve metal anodic electrical contact rolls have further, metal-containing coating.

18. The apparatus of claim 1 wherein said anodic electrical contact rolls are augmented by additional anodic contact elements positioned between said contact rolls.

19. The apparatus of claim 1 wherein said anodic electrical contact rolls comprise hollow or solid cylinders.

20. The apparatus of claim 1 wherein said liquid supply means comprises hollow and perforate plastic feed members having offset perforations.

21. The apparatus of claim 1 wherein said electrical supply means comprise resilient, spring loaded and copper-containing contact elements pressed against copper containing anode electrical contact rolls.

22. The apparatus of claim 1 wherein said liquid collection means comprises a non-conductive plastic trough.

23. The apparatus of claim 1 and electrically conductive cylindrical backup rolls positioned beneath said electrical drive rolls with room therebetween for a workpiece.

24. The apparatus of claim 1 and a planar support plate positioned beneath said electrical drive rolls with room therebetween for a workpiece.

25. The apparatus of claim 1 and a cylindrical metal cathodic contact roll.

26. The apparatus of claim 25 wherein said cathodic contact roll comprises a valve metal coated, electrically conductive metal cylinder spaced apart from said anodic electrical contact rolls along the path of travel of a workpiece and before said workpiece proceeds through said apparatus.

27. The apparatus of claim 25 wherein said cathodic contact roll is at least partially wrapped by a workpiece during its path of travel, while copper-containing, spring-loaded electrical contact elements are pressed in electrical contact against a face area of said cathodic contact roll in a zone removed from roll contact with said workpiece.

28. The apparatus of claim 1 wherein said drive rolls and said anodic electrical contact rolls are mounted on a carriage.

29. The apparatus of claim 1 and liquid replenishing means connecting with said liquid collection means.

30. The apparatus of claim 29 wherein said liquid replenishing means collects liquid from said liquid collection means and is connected to said liquid supply means.

31. In a belt electroplating apparatus adapted for the high speed electroplating of a moving strip of metal, the improvement in said apparatus comprising a unified anodic roll member for movement in and out of contact with the path of travel of a workpiece to be electroplated, said member comprising:

a moveable carriage member;

cylindrical, non-conductive drive roll elements connected to said moveable carriage member;

hollow and cylindrical, valve metal anodic electrical contact roll elements connected to said moveable carriage member;

a flexible, perforate and electrolyte permeable continuous and non-sacrificial belt anode having an exterior surface of electrocatalytic coating containing metal oxide, said belt anode being a continuous loop anode in contact with said drive roll elements and said anodic electrical contact roll elements; and a thermoplastic, non-conductive and acid-resistant porous resin covering in snug fit around said flexible belt anode, with said resin covering having a thickness of not substantially greater than about 1.5 centimeters as well as having interconnected voids providing porosity of at least about 50 percent by volume.

32. The method of metal electroplating a moving strip of metal wherein a moving belt anode provides for contact to a cathodic metal strip, which method comprises:

contacting said metal strip in a flat surface electroplate zone with a flexible, electrolyte permeable, non-sacrificial belt anode capable of rotational movement, said anode comprising an at least substantially continuous valve metal belt having an exterior surface electrocatalytic coating containing metal oxide, said anode having a snugly fit, thin, non-conductive and highly porous outer belt covering of synthetic resin, with said outer belt covering containing metal electroplating solution;

moving said outer belt covering in contact with said metal strip at a rate providing relative movement between said strip and said covering;

contacting said metal strip with a cylindrical, metal cathodic contact roll spaced apart along the path of travel of said metal strip from said anodic contact;

supplying electrolyte through said electrolyte permeable belt anode to said porous outer belt covering at said electroplate zone;

impressing a current between said anode and said cathode; and electroplating said metal strip at a current density of not above about 10,000 ASF of anode area.

33. The method of claim 32 wherein said moving metal strip proceeds in contact with said outer belt covering and the line speed of said strip is less than the speed of said covering.

34. The method of claim 32 wherein said belt anode and outer belt covering proceed at the same rate of movement.

35. The method of claim 32 wherein said outer belt covering contacts said metal strip in said electroplate zone in at least substantially flat, horizontal contact and by reverse coating technique.

36. The method of claim 32 wherein said outer belt covering contacts said metal strip in said electrolyte zone in at least substantially flat contact and by direct coating technique.

37. The method of claim 32 wherein electrolyte feeds to said outer belt covering between cylindrical metal anodic contact rolls and thereafter travels through said electrolyte permeable belt anode to said porous outer belt covering.

38. The method of claim 37 wherein said belt anode proceeds through said electroplate zone in contact with said anodic contact rolls.

39. The method of claim 38 wherein said belt anode, porous outer belt covering and anodic contact rolls travel at the same speed relative one with the other.

40. The method of claim 32 wherein a steel strip is electroplated with zinc, zinc-iron or zinc-nickel plate at a current density of above about 3,500 amperes per square foot of anode area.

41. The method of claim 32 wherein said metal strip is contacted with said cathodic contact roll in wrapped contact prior to contact with said porous outer belt covering.

42. The method of claim 32 wherein said metal strip following electroplating is water rinsed to remove excess electrolyte therefrom and is subsequently dried.

43. The method of claim 32 wherein said metal strip is contacted by said belt anode at a belt anode linear velocity within the range of from about 10 to about 1,000 ft/min.

* * * * *